US005589742A

United States Patent [19]

Ueda

[11] Patent Number: 5,589,742

[45] Date of Patent: Dec. 31, 1996

[54] DISCHARGING LAMP LIGHTING APPARATUS HAVING OPTIMAL LIGHTING CONTROL

[75] Inventor: Hiroyuki Ueda, Hyogo, Japan

[73] Assignee: Mitsubishi Denki Kabushiki Kaisha, Tokyo, Japan

[21] Appl. No.: 428,618

[22] Filed: Apr. 25, 1995

Related U.S. Application Data

[63] Continuation of Ser. No. 47,484, Apr. 19, 1993, abandoned.

[30] Foreign Application Priority Data

Apr. 23, 1992 [JP] Japan ..... 4-129365
Sep. 22, 1992 [JP] Japan ..... 4-276791

[51] Int. Cl.[6] ..... H05B 37/02

[52] U.S. Cl. ..... 315/307; 315/DIG. 7; 315/219; 315/224

[58] Field of Search ..... 315/219, 224, 315/307, DIG. 7

[56] References Cited

U.S. PATENT DOCUMENTS

| | | | |
|---|---|---|---|
| 4,240,009 | 12/1980 | Paul | 315/117 |
| 4,388,561 | 6/1983 | Koshimura et al. | 315/224 |
| 4,672,271 | 6/1987 | Gear et al. | 315/224 |
| 4,900,990 | 2/1990 | Sikora | 315/241 P |
| 4,902,938 | 2/1990 | Lindquist | 315/307 |
| 4,996,464 | 2/1991 | Dodd et al. | 315/307 |
| 5,039,921 | 8/1991 | Kakitani | 315/307 |
| 5,051,665 | 9/1991 | Garrison et al. | 315/307 |
| 5,099,407 | 3/1992 | Thorne | 363/37 |
| 5,128,592 | 7/1992 | Dean et al. | 315/307 |
| 5,212,428 | 5/1993 | Sasaki et al. | 315/307 |
| 5,235,254 | 8/1993 | Ho | 315/307 |
| 5,465,029 | 11/1995 | Hanazaki et al. | 315/308 |

FOREIGN PATENT DOCUMENTS

| | | |
|---|---|---|
| 4033664 | 5/1991 | Germany . |
| 4015398 | 11/1991 | Germany . |
| 3138894 | 6/1991 | Japan . |
| 412495 | 1/1992 | Japan . |
| 4141988 | 5/1992 | Japan . |

*Primary Examiner*—Robert Pascal
*Assistant Examiner*—Darius Gambino

[57] ABSTRACT

A discharging lamp lighting apparatus is provided to perform lighting control of high voltage discharging lamps such as high pressure sodium lamp or metal halide lamp. In the discharging lamp lighting apparatus, a control section determines a power control pattern balancing with stored discharging lamp stable voltage so as to perform power control of the discharging lamp according to the pattern. If no voltage is stored, the control section performs the power control according to a power control pattern balancing with the minimum rated voltage of the discharging lamp. Then, it is possible to store the voltage when the discharging lamp is stabilized. If the discharging lamp is exchanged, the control section erases contents in stable voltage storing means so as to perform the lighting control of the discharging lamp from an initial state. As a result, the discharging lamp lighting apparatus can continuously perform the lighting control with the optimal rise characteristic of the amount of light even if characteristics of the discharging lamp may be varied due to, for example, degradation thereof.

24 Claims, 8 Drawing Sheets

DISCHARGING LAMP LIGHTING APPARATUS HAVING OPTIMAL LIGHTING CONTROL

This application is a continuation, of application Ser. No. 08/047,484 filed on Apr. 19, 1993, now abandoned.

BACKGROUND OF THE INVENTION

1. Field of the Invention

The present invention relates to a discharging lamp lighting apparatus for performing lighting control of high voltage discharging lamps such as high pressure sodium lamp or metal halide lamp, for use in headlamps of vehicles.

2. Description of the Prior Art

A high voltage discharging lamp is a lamp into which vapor of metal such as halogenated metal or sodium is sealed as light emitting material so as to use discharge for light emission. In the high voltage discharging lamp, high voltage is applied across electrodes when starting to light. The high voltage discharging lamp is widely used for headlamps of vehicles because of facilitation of small-sized design thereof, and high efficiency.

However, there is a drawback in that a time of about several seconds is required for reaching a stable state of discharge when starting to light. Further, if a control constant at a time when starting to light is set so as to reach a desired amount of light for a shorter time interval, the amount of light becomes excessive when reaching the stable state of discharge. Thus, there is another drawback in that life of the discharging lamp is reduced.

FIG. 1 is a circuit block diagram illustrating a conventional discharging lamp lighting apparatus which can overcome the problems, and is disclosed in, for example, Japanese Patent Application Laid-Open No. 2-215,090. In FIG. 1, reference numeral 2 means an inverter circuit for converting DC current into AC current at a predetermined frequency, 4 means LC series resonance circuit for applying high voltage to a discharging lamp 5, including a choke coil L and capacitors $C_1$, $C_2$, 21 is AC power source serving as an energy supplying source, 22 is a full wave rectifying circuit for performing full wave rectification with respect to AC voltage from the AC power source 21, and 23 is a control section for outputting a signal $S_1$ which controls the inverter circuit 2. Further, a resistor R connected to the discharging lamp 5 serves to detect discharge current value flowing through the discharging lamp 5 as voltage value.

A description will now be given of the operation. When a light switch (not shown) for instructing ON and OFF of the discharging lamp 5 is turned ON, the control section 23 is started to operate so as to set a frequency of the signal $S_1$ to 100 kHz. The inverter circuit 2 generates AC power of 100 kHz according to the frequency of the signal $S_1$. Subsequently, the AC power is supplied to the LC series resonance circuit 4.

The LC series resonance circuit 4 generates high voltage of on the order of 10 kV, and the high voltage is applied to the discharging lamp 5. Further, the high voltage causes dielectric breakdown in the sealed gas of the discharging lamp 5. Since voltage is developed across the resistor R due to discharge current generated by the occurrence of the dielectric breakdown, the control section 23 can recognize a time point of the occurrence of the dielectric breakdown by detecting the voltage.

When the control section 23 recognizes the occurrence of the dielectric breakdown, the control section 23 is operated to set the frequency of the signal $S_1$ to a low value of, for example, 4 kHz so as to increase a discharge current value. Thus, voltage of 4 kHz is applied to the LC series resonance circuit 4. As the frequency is increased, integral value of the current is reduced by the choke coil L of the LC series resonance circuit 4 so that current flowing through the discharging lamp 5 is reduced. That is, if the frequency is reduced, the discharge current is increased to reduce a time required for the discharging lamp 5 reaching the stable state.

However, the discharge current in the stable state is further increased if the frequency is left, and the amount of light is kept excessive. Hence, the control section 23 is operated to set the frequency of the signal $S_1$ to a predetermined value of, for example, 10 kHz to control the discharge current so as to generate, at a predetermined time point, a condition where the discharge current according to the desired amount of light can flow through the discharging lamp 5.

In this case, if the frequency is rapidly varied from 4 kHz to 10 kHz, the amount of light is also varied rapidly. Consequently, when the discharging lamp 5 is used for the headlamp of the vehicle, the discharging lamp 5 may dazzle a passerby or a driver of another vehicle. Hence, the control section 23 is operated to perform the following control so as to gradually vary the amount of light.

That is, the control section 23 is operated to determine whether or not a time of 100 ms has elapsed, and is operated to increase the frequency of the signal $S_1$ by 50 Hz each time when the time of 100 ms is elapsed. After the frequency of the signal $S_1$ reaches 6 kHz, the control section 23 is operated to increase the frequency of the signal $S_1$ by 100 Hz each time when the time of 100 ms is elapsed. Finally, when reaching 10 kHz, the frequency is fixed to the value of 10 kHz.

As set forth before, it is possible to enhance rise characteristics of the amount of light, and overshadow the variation in the amount of light.

Since the prior art discharging lamp lighting apparatus is provided as described hereinbefore, a final value of the frequency of the signal $S_1$ is a fixed value of, for example, 10 kHz. Thus, in case, for example, a time elapsing variation occurs in characteristics of the discharging lamp 5 or the mounted discharging lamp 5 is exchanged, there are drawbacks in that the amount of light may be excessive depending upon the variation or a new discharging lamp 5, and the life of the discharging lamp 5 is reduced.

SUMMARY OF THE INVENTION

In view of the foregoing, it is an object of the present invention to provide a discharging lamp lighting apparatus which implements the optimal rise characteristic of an amount of light in each discharging lamp having varying characteristics.

It is another object of the present invention to provide a discharging lamp lighting apparatus which can be continuously adapted to a varied characteristic of a discharging lamp even if the characteristic of the discharging lamp may be varied, so as to rapidly provide a stable state of the amount of light.

It is still another object of the present invention to provide a discharging lamp lighting apparatus which can prevent the amount of light of the discharging lamp from being excessive when applying rated power in case stable voltage is not stored, and can avoid a reduced life of the discharging lamp.

It is further object of the present invention to provide a discharging lamp lighting apparatus which can be prevented from storing voltage in an unstable state, and can avoid control according to an erroneous power control pattern.

It is still further object of the present invention to provide a discharging lamp lighting apparatus which can avoid abnormal lighting control or lighting control exceeding the rating of a new discharging lamp immediately after exchanging a discharging lamp even if an abnormal value or higher voltage is stored in a stable voltage storage as a final discharging lamp voltage due to failure or expired lifetime of the discharging lamp.

According to the first aspect of the present invention, for achieving the above-mentioned objects, there is provided a discharging lamp lighting apparatus including a power supply for supplying power for a a discharging lamp, dielectric breakdown detector for detecting dielectric breakdown of the discharging lamp, a voltage detector for detecting voltage of the discharging lamp, a stable voltage storage for storing voltage when the discharging lamp is stabilized, and a controller for providing the power supply with an instruction of defining the voltage stored in the stable voltage storage as a target value when the dielectric breakdown detector detects occurrence of the dielectric breakdown of the discharging lamp, and damping current value of current flowing through the discharging lamp to current value such that the voltage of the discharging lamp becomes the target voltage when power consumption of the discharging lamp becomes rated current.

Consequently, in the discharging lamp lighting apparatus according to the first aspect, the controller serves to control the power of the discharging lamp according to a power control pattern balancing with stored stable voltage after the dielectric breakdown of the discharging lamp.

According to the second aspect of the present invention, there is provided a discharging lamp lighting apparatus including a power supply for supplying power for a discharging lamp, a dielectric breakdown detector for detecting dielectric breakdown of the discharging lamp, a voltage detector for detecting voltage of the discharging lamp, a stable voltage storage for storing voltage when the discharging lamp is stabilized, and a controller for providing the power supply with an instruction of defining voltage in the stable voltage storage means as a target value in case the voltage is stored in the stable voltage storage, or defining the minimum rated voltage of the discharging lamp as the target voltage if no voltage is stored in the stable voltage storage when the dielectric breakdown detector detects occurrence of the dielectric breakdown of the discharging lamp, and damping current flowing through the discharging lamp to current value such that the voltage of the discharging lamp becomes the target voltage when power consumption of the discharging lamp becomes the rated power.

Consequently, in the discharging lamp lighting apparatus according to the second aspect, the controller serves to perform power control of the discharging lamp according to a power control pattern balancing with the minimum rated voltage of the discharging lamp when no stable voltage is stored after the dielectric breakdown of the discharging lamp.

According to the third aspect of the present invention, there is provided the discharging lamp lighting apparatus according to the first aspect or the second aspect, wherein the stable voltage storage further includes a timer for measuring time, and a decider for deciding that the discharging lamp is stabilized if a timer measuring time interval from start of lighting exceeds a predetermined time interval.

Consequently, in the discharging lamp lighting apparatus according to the third aspect, the stable voltage storage decides whether or not voltage should be stored therein according to an elapsed time from the start of lighting when storing the voltage.

According to the fourth aspect of the present invention, there is provided a discharging lamp lighting apparatus further including a discharging lamp detector for detecting a mounted discharging lamp, and a controller means having an additional function of erasing stored contents in the stable voltage storage when the detector detecting means detects that the discharging lamp is once removed, and performing lighting control of the discharging lamp from an initial state Consequently, in the discharging lamp lighting apparatus according to the fourth aspect, the controller erases the stored content in the stable voltage storage upon detecting that the discharging lamp is once removed, and controls lighting of the discharging lamp from the initial state.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the invention will now be described in detail referring to the accompanying drawings.

EMBODIMENT 1

Figure 1:
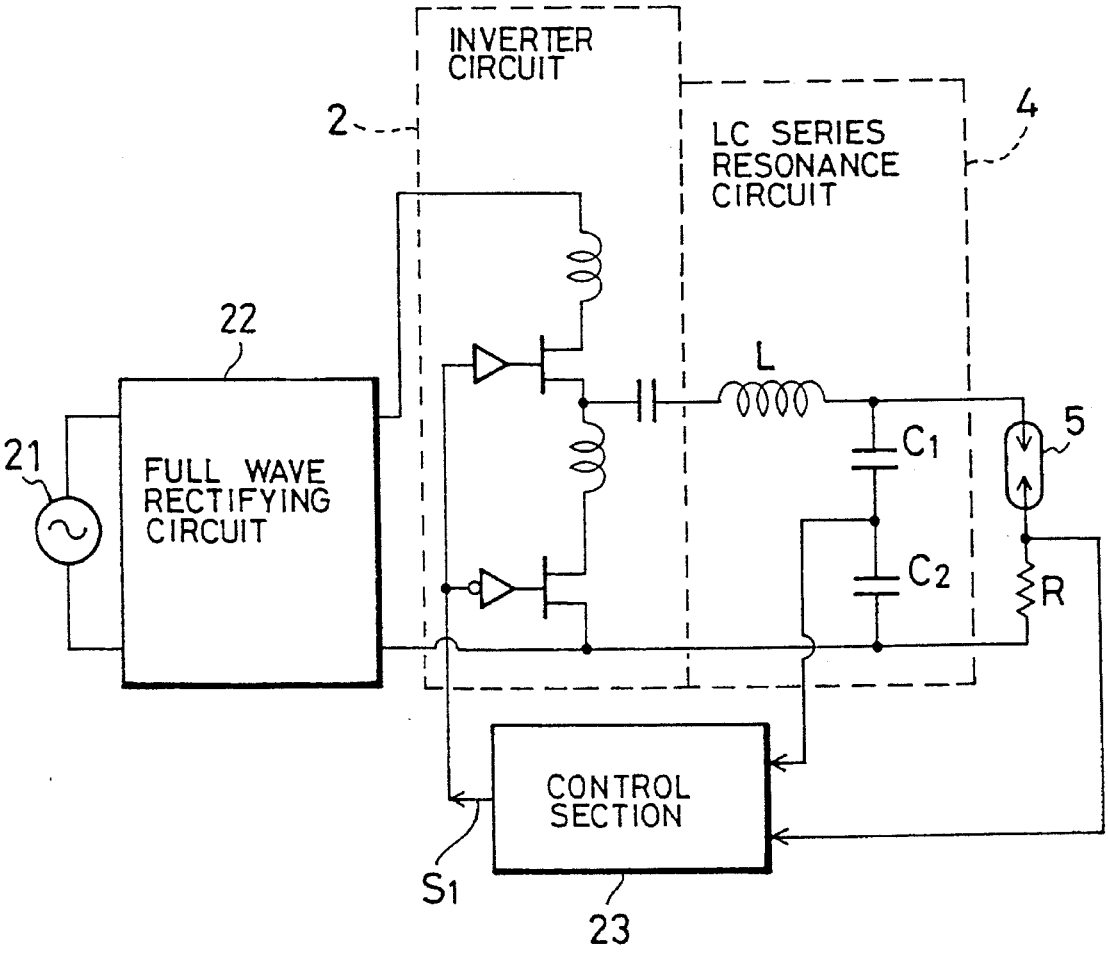
FIG. 1 ( PRIOR ART )
FIG. 1 is a circuit block diagram showing a conventional discharging lamp lighting apparatus.
Figure 2:
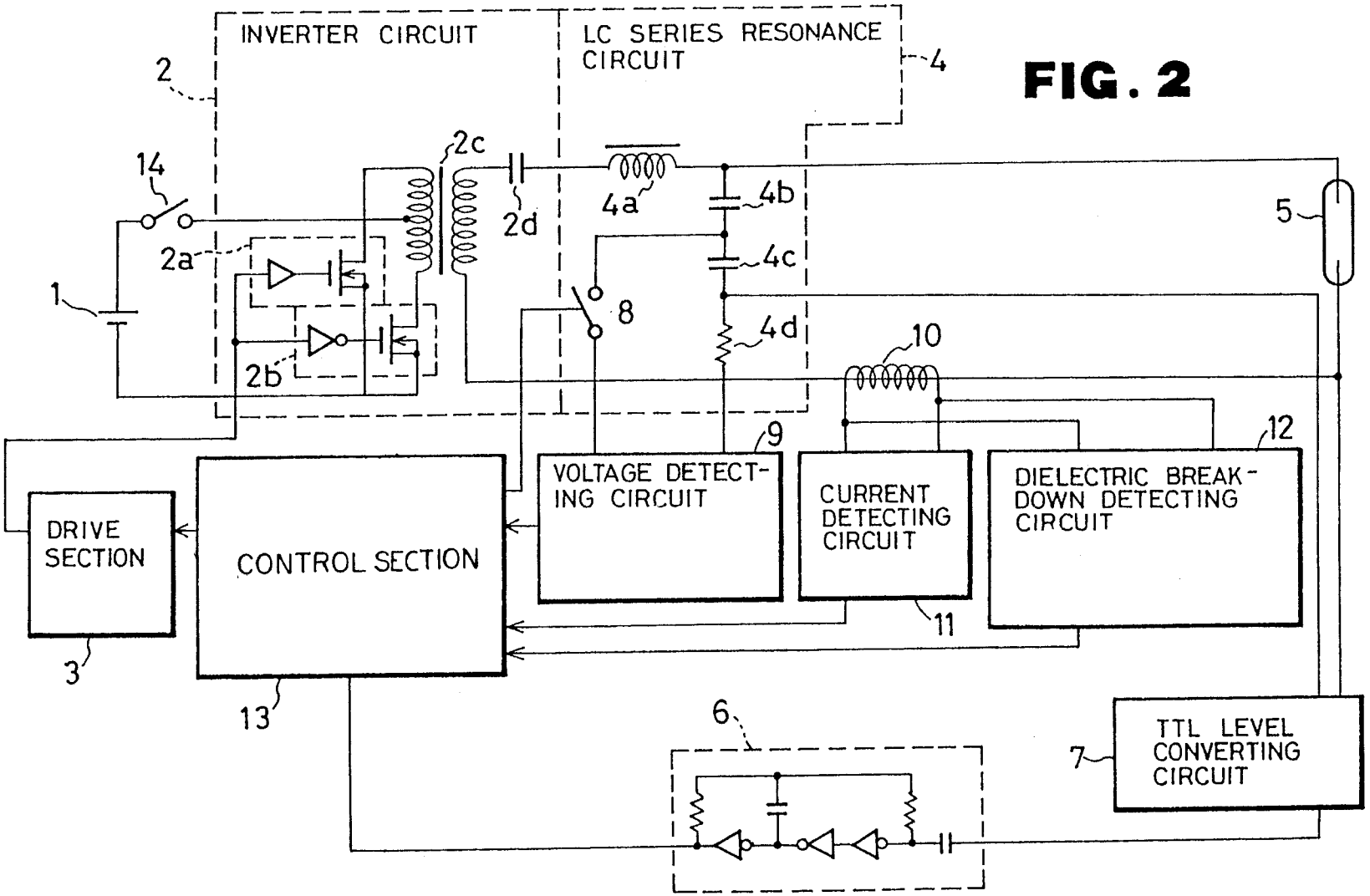
FIG. 2 is a circuit block diagram showing the embodiment 1 of the present invention.

FIG. 2 is a circuit block diagram showing a discharging lamp lighting apparatus according to the first embodiment of the present invention. In FIG. 2, reference numeral 1 means a battery, 2 means an inverter circuit, 3 is a drive section for performing, for example, signal amplification, 4 is LC series resonance circuit, 5 is a discharging lamp, 6 is a self-excited oscillation circuit serving as a primary oscillation section to output resonance frequency, 7 is TTL level converting circuit for converting level of input signal into TTL level, 8 is a switch, 9 is a voltage detecting circuit for detecting a value according to voltage across electrodes of the discharging lamp 5, 10 is a current transformer, 11 is a current detecting circuit for detecting current flowing through the discharging lamp 5 via the current transformer 10, 12 is a dielectric breakdown detecting circuit for detecting dielectric breakdown of the discharging lamp 5 via the current transformer 10, 13 is a control section, and 14 is a light switch mounted to a vehicle.

In the inverter circuit 2, reference numerals 2*a*, 2*b* mean switching devices which are alternately turned 0N and OFF so as to convert DC current of the battery 1 into AC current, 2*c* means a boosting transformer for boosting the AC current to a predetermined value, and 2*d* is a coupling capacitor for conducting the AC current to a next stage.

In the LC series resonance circuit 4, reference numeral 4*a* means a choke coil, 4*b*, 4*c* mean capacitors, and 4*d* is a resistor. In order to avoid reduction of Q (quality factor) of the resonance circuit, a value of resistance in the resistor 4*d* is defined as a negligible value as compared to effective resistance due to the choke coil 4*a* and the capacitors 4*b*, 4*c* in resonance.

The control section 13 includes, for example, a microcomputer, and serves to indicate ON/OFF of the switch 8 and control frequency supplied for the inverter circuit 2 depending upon output signals from the voltage detecting circuit 9, the current detecting circuit 11, and the dielectric breakdown detecting circuit 12.

In this case, the power supply is implemented by the battery 1, the inverter circuit 2 and the LC series resonance circuit 4, the dielectric breakdown detector is implemented by the current transformer 10 and the dielectric breakdown detecting circuit 12, and voltage detection is implemented by the voltage detecting circuit 9 and the current transformer 10. Further, control is implemented by the control section 13 such as microcomputer, and stable voltage storing circuit is also implemented by the control section 13. In addition, a timer for stable voltage storage is implemented by, for example, a time in the microcomputer, and the control section 13 further includes a decision section.

Figure 3:
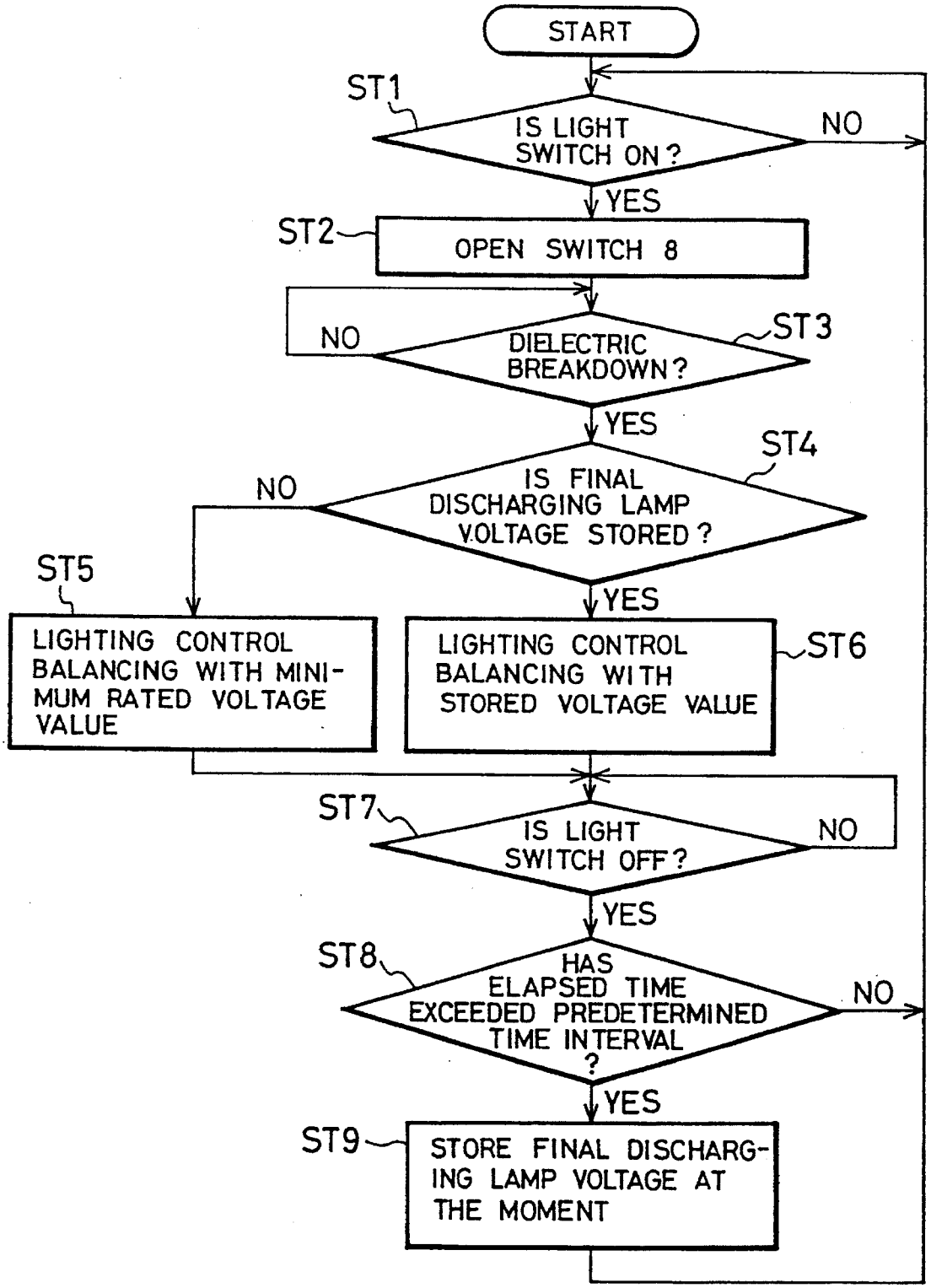
FIG. 3 is a flow chart showing an operation of a control section in the embodiment 1.

A description will now be given of the operation with reference to flow charts of FIGS. 3 and 4. The control section 13 determines whether or not the light switch 14 is turned ON (Step ST1). If the light switch 14 is ON, the control section 13 is operated to open the switch 8 so as to open an input terminal of the voltage detecting circuit 9 (Step ST2). On the other hand, the self-excited oscillation circuit 6 is in an operable condition so as to output a signal having a self-excited oscillation frequency according to ON state of the light switch 14. The signal is supplied for the inverter circuit 2 via the control section 13 and the drive section 3.

The inverter circuit 2 supplies the LC series resonance circuit 4 with AC power having frequency according to the oscillation frequency thereof so that the LC series resonance circuit 4 generates high voltage. Subsequently, the high voltage is applied to the discharging lamp 5 so as to cause the dielectric breakdown in the discharging lamp 5. At the time, the discharging lamp 5 is in a substantially short-circuited state in a moment, and the current flows through the discharging lamp 5. Thereafter, as a gas temperature in the discharging lamp 5 increases, impedance in the discharging lamp 5 is increased.

At the time, the flowing current is rush current having a peak value of 20 to 50 A, and a oscillation cycle of hundreds ns. The current detecting circuit 11 serves to monitor the current from the discharging lamp 5 via the current transformer 10 so as to detect the rush current. The control section 13 determines that the dielectric breakdown occurs if output signal from the current detecting circuit 11 indicates detection of the rush current (Step ST3).

The control section 13 stops to supply the inverter circuit 2 with signal from the self-excited oscillation circuit 6 when recognizing the occurrence of the dielectric breakdown. Further, the switch 8 is ON so that the voltage detecting circuit 9 is in a voltage detectable state. Subsequently, the control section 13 provides the inverter circuit 2 with the signal having frequency corresponding to a maximum rating current via the drive section 3 such that the maximum rating current flows through the discharging lamp 5.

Here, the control section 13 recognizes a current value flowing through the discharging lamp 5 via the current detecting circuit 11, and decides whether or not the discharging lamp is turned ON by comparing the current value with a predetermined value. When the discharging lamp 5 is not turned ON, the operation returns to Step ST1 to again execute processing as described above, and the following power control is performed when the discharging lamp 5 is turned ON.

First, the control section 13 determines whether or not final discharging lamp voltage is stored (Step ST4). If not stored, control balancing with the minimum rated voltage value of the discharging lamp occur (Step ST5). Alternatively, control balancing with the stored voltage occurs if final discharging lamp voltage if stored (Step ST6).

Figure 4:
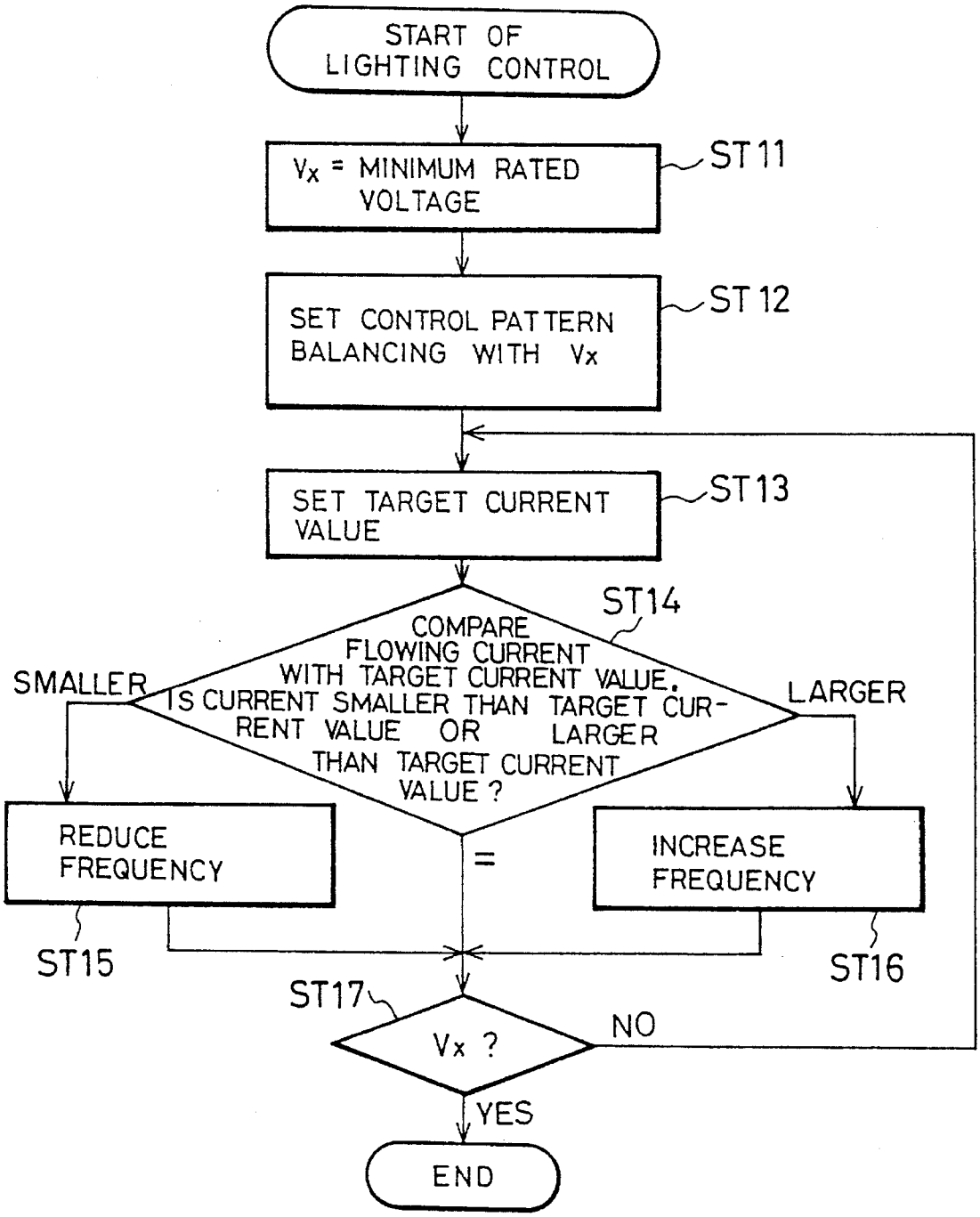
FIG. 4 is a flow chart showing power control in the embodiment.

The control balancing with the minimum rated voltage value is executed as shown in the flow chart of FIG. 4. That is, the control section 13 is operated to set the minimum rated voltage as a target voltage $V_x$ so as to set a power control pattern according to the target voltage $V_x$ (Step ST11). As a preferred embodiment, the power control pattern may include the following pattern.

That is, the current value flowing through the discharging lamp is controlled to be gradually damped from a current value such that power consumption of the discharging lamp 5 becomes the maximum rated value (which is defined as 75 W in the embodiment), to a current value such that the voltage of the discharging lamp becomes the target voltage $V_x$ at the rated power (which is defined as 35 W in the embodiment).

Figure 5:
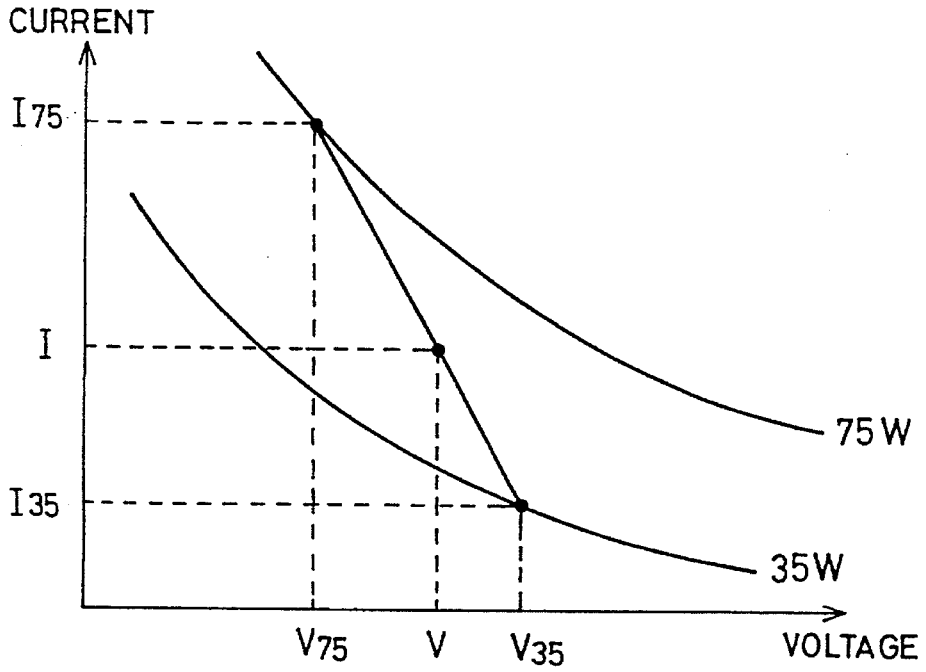
FIG. 5 is an explanatory view showing a power control pattern in the embodiment.

FIG. 5 shows one embodiment of the power control pattern. If the target voltage $V_x$ is $V_{35}$, the power is preferably 35 W when reaching the target voltage. Therefore, it is possible to express the current $I_{35}$ in the following expression:

$$I_{35}=35(W)/V_{35}$$

where power factor is defined as 1.

Further, provided that $V_{75}$ is voltage detected when starting the control, current $I_{75}$ can be given by the following expression:

$$I_{75}=75(W)/V_{75}$$

because the power at the time is defined as 75 W.

At the beginning, the control section 13 adjusts the frequency of signal output into the inverter circuit 2 such that the current $I_{75}$ flows through the discharging lamp 5.

Thereafter, since the impedance of the discharging lamp 5 is increased in process of time, the voltage of the discharging lamp 5 is increased. The control section 13 sets the current of the discharging lamp 5 such that the current has current values on the line of FIG. 5 at regular time interval (of, for example, 100 ms). The current I can be given by the following expression:

$$I=(V-V_{35})\cdot(I_{35}-I_{75})/(V_{35}-V_{75})+I_{35}$$

where V represents voltage detected at the time.

The control section 13 adjusts the frequency such that the current value of the discharging lamp 5 becomes the value (Step ST13). Further, the control section 13 compares the current flowing in actuality with the target current (Step ST14).

If the current value detected by the current detecting circuit 11 is smaller than the target current, the control section 13 reduces the frequency of the signal provided for the inverter circuit 2 (Step ST15). If the current value is larger than the target current, the control section 13 increases the frequency (Step ST16). This power control is repeated until the actual voltage of the discharging lamp 5 reaches the target voltage $V_x$, and is terminated when reaching the target voltage $V_x$ (Step ST17).

In such a way, the current value is gradually varied from a value according to power of 75 W to a value according to power of 35 W. At the point of the termination of the power control, power of 35 W is supplied for the discharging lamp 5. Thereafter, the control section 13 maintains the power of 35 W while adjusting the frequency of the signal. That is, constant power control is performed. If the discharging lamp voltage exceeds the target voltage $V_x$ during the power control, the frequency is thereafter adjusted to maintain the power of 35 W.

The lighting control balancing with the stored voltage value is also performed according to processing in the flow chart of FIG. 4. In this case, the stored voltage value is used as the target voltage $V_x$.

Figure 6:
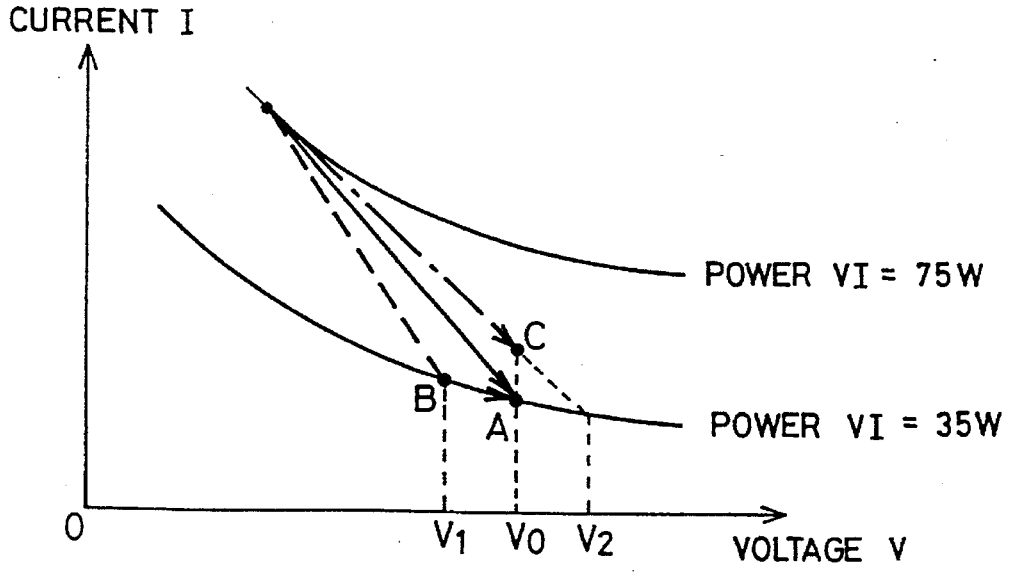
FIG. 6 is an explanatory view showing a current/voltage characteristic of a discharging lamp in the embodiment.

FIG. 6 illustrates a state of the power control corresponding to various target voltage. In FIG. 6, the solid line arrow indicates a control in case the final discharging lamp voltage is stored. Reference numeral $V_0$ represents discharging lamp stable voltage at the rated power (of, for example, 35 W). Further, final discharging lamp stable voltage is defined as $V_0$. In FIG. 6, voltage on a lateral axis represents the voltage of the discharging lamp 5 which is detected by the voltage detecting circuit 9, and current on a longitudinal axis represents current flowing through the discharging lamp 5, which is detected by the current detecting circuit 11.

The broken line arrow in FIG. 6 illustrates a state of control in case employing voltage $V_1$ which is smaller than voltage $V_0$ as the target voltage $V_x$. This case corresponds to conventional control, and to the lighting control balancing with the minimum rated voltage value in the discharging lamp lighting apparatus. In this case, the control section 13 performs the power control by using the power control pattern balancing with the voltage $V_1$. However, the control section 13 is switched over to the constant power control at a time when detecting that the voltage of the discharging lamp 5 becomes the target voltage $V_x$ (which is $V_1$ in this case) at Step ST17. Accordingly, the voltage of the discharging lamp 5 is gradually varied toward the stable voltage. Thus, the amount of light is gradually increased toward 100% of the amount of light as shown in FIG. 7B. As used herein "100% of the amount of light" means the amount of light when the discharging lamp 5 is turned ON at the rated power.

The one dotted line of FIG. 6 indicates a state of control in case employing voltage $V_2$ which is larger than the voltage $V_0$ as the target voltage $V_x$. The control section 13 performs the power control by using the power control pattern balancing with the voltage $V_2$. However, if the voltage of the discharging lamp 5 reaches the voltage $V_0$, the voltage is not increased more than the voltage $V_0$. The power at a time when the voltage of the discharging lamp 5 reaches the voltage $V_0$, is larger than the rated power. Hence, overshoot may be generated in the rise characteristic of the discharging lamp 5, and the amount of light in a stable state may exceed the amount of light in the rated power as shown in FIG. 7C.

Figure 7A:
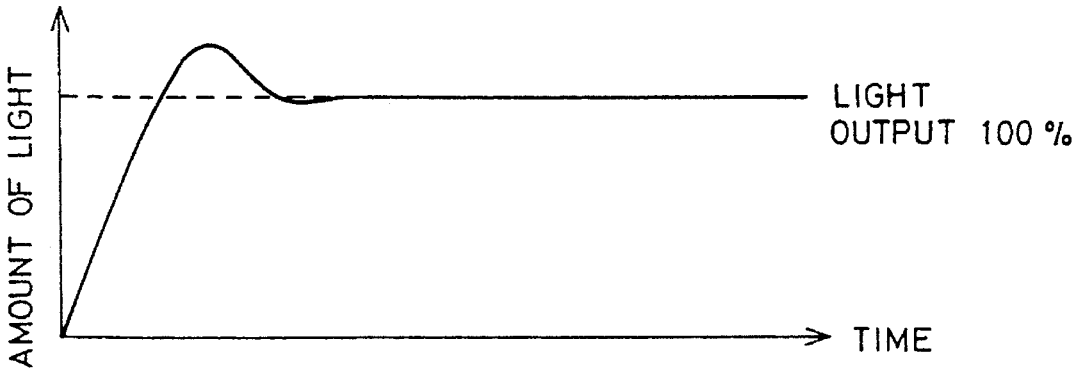
FIGS. 7A–7C are explanatory views showing rise characteristics of the discharging lamp in the embodiment.
Figure 7B:
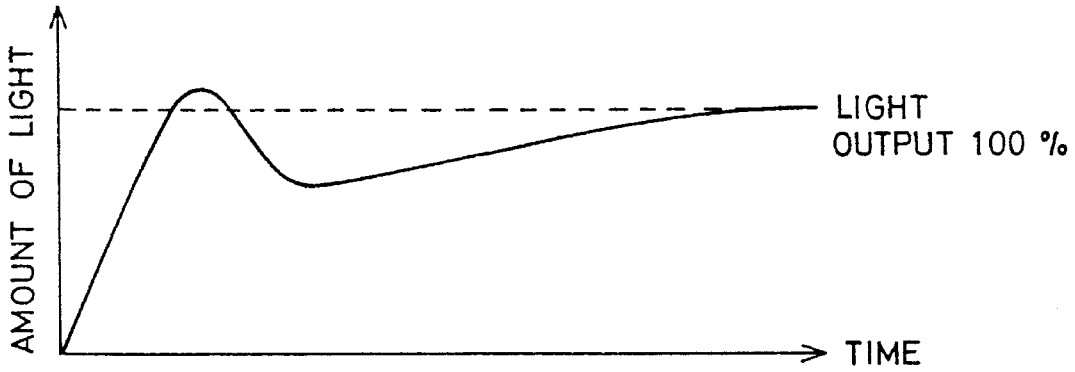
Figure 7C:
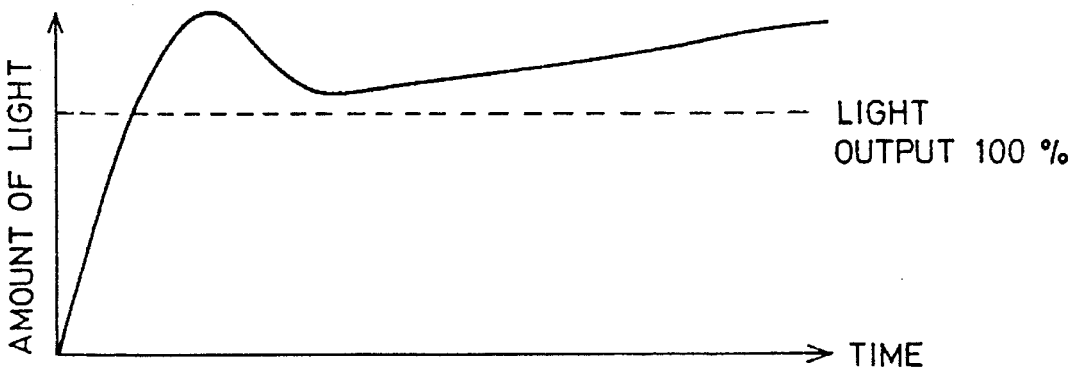

FIG. 7A illustrates the rise characteristic of the amount of light according to control in case the final discharging lamp voltage is stored. As seen from the drawing, the amount of light is stabilized rapidly if the final discharging lamp voltage is stored.

After the power control when lighting is completed, the control section 13 adjusts the frequency to maintain the power supplied for the discharging lamp 5 at the rated power. If the control section 13 detects OFF of the light switch 14 (Step ST7), the control section 13 determines that the discharging lamp 5 is in the stable state (Step ST8). Accordingly, the control section 13 stores the voltage of the discharging lamp 5, which is detected at the moment by the voltage detecting circuit 9 (Step ST9). The stored voltage value is used as the final discharging lamp voltage when performing the next lighting control. The control section 13 can detect the stable state of the discharging lamp 5 depending upon the elapse of time from the start of lighting measured by the timer exceeding a predetermined value. The predetermined value can be found through experiment in advance.

As set forth above, if the light switch 14 is turned OFF before the discharging lamp 5 is in the stable state, no voltage can be stored. Accordingly, it is possible to avoid storage of the voltage in an unstable state. Further, since the discharging lamp voltage is stored for each lighting operation, it is possible to perform the optimal control as desired even if the discharging lamp stable voltage is varied due to degradation of the discharging lamp 5. If the light switch 14 is turned OFF during processing of Steps ST3 to ST6, the operation returns to Step ST1.

EMBODIMENT 2

Figure 8:
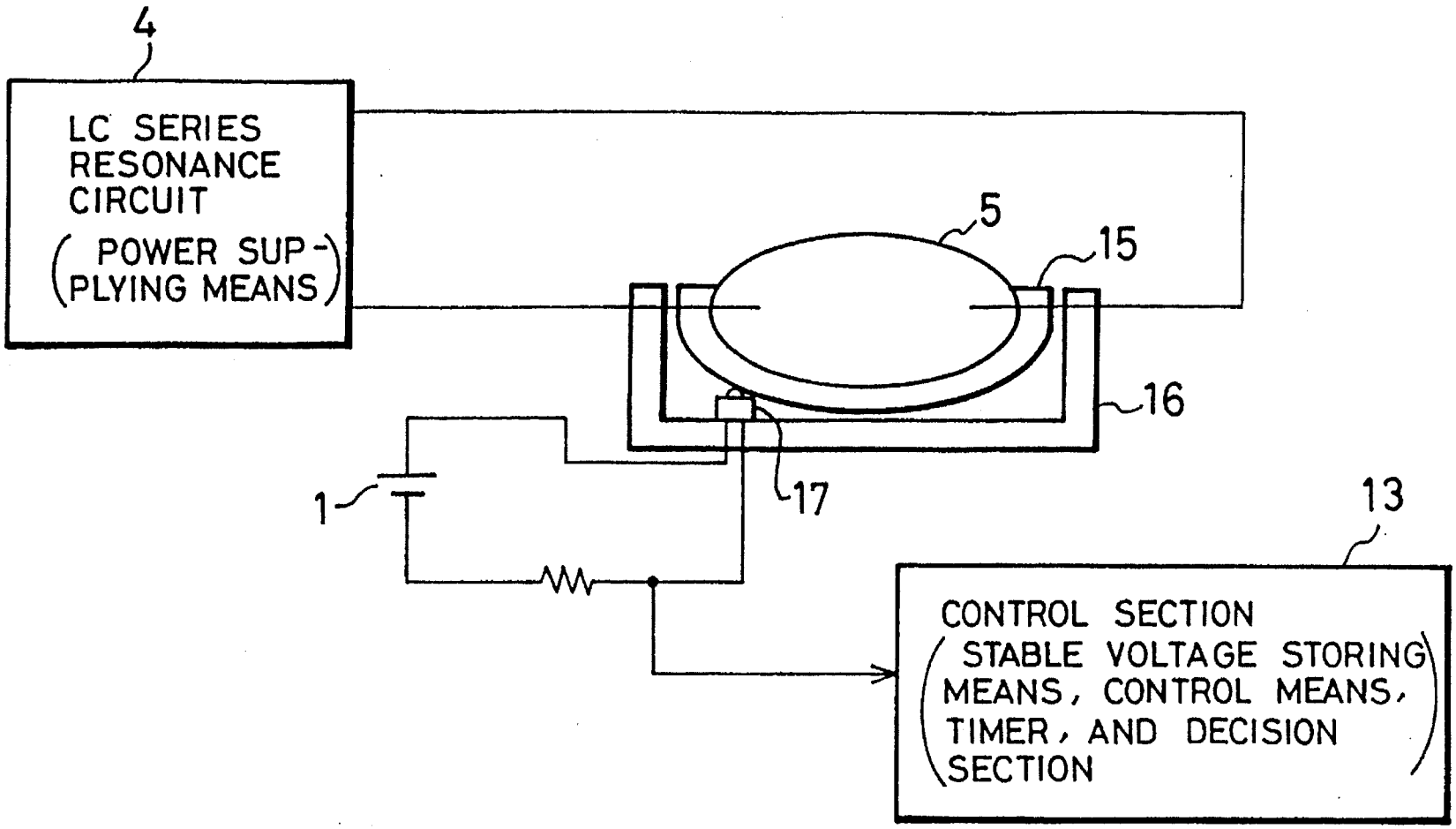
FIG. 8 is a circuit block diagram showing an essential part of the embodiment 2 of the present invention.

A description will now be given of the embodiment 2 with reference to the drawings. FIG. 8 is a circuit block diagram showing an essential part of the embodiment 2 of the present invention. In FIG. 8, the component parts identical with those of FIG. 2 are designated by the same reference numerals, and the descriptions of the identical component parts are omitted. In FIG. 8, reference numeral 15 means a socket for fixing the discharging lamp 5, and 16 means a fixed base for fixing the socket 15 including the discharging lamp 5. Reference numeral 17 means a discharging lamp detector for detecting whether or not the discharging lamp 5 is mounted. The discharging lamp detector 17 includes a sensor switch which is turned OFF when the discharging lamp 5 having the socket 15 is mounted on the fixed base 16, and is automatically turned ON when the discharging lamp 5 is removed.

Figure 9:
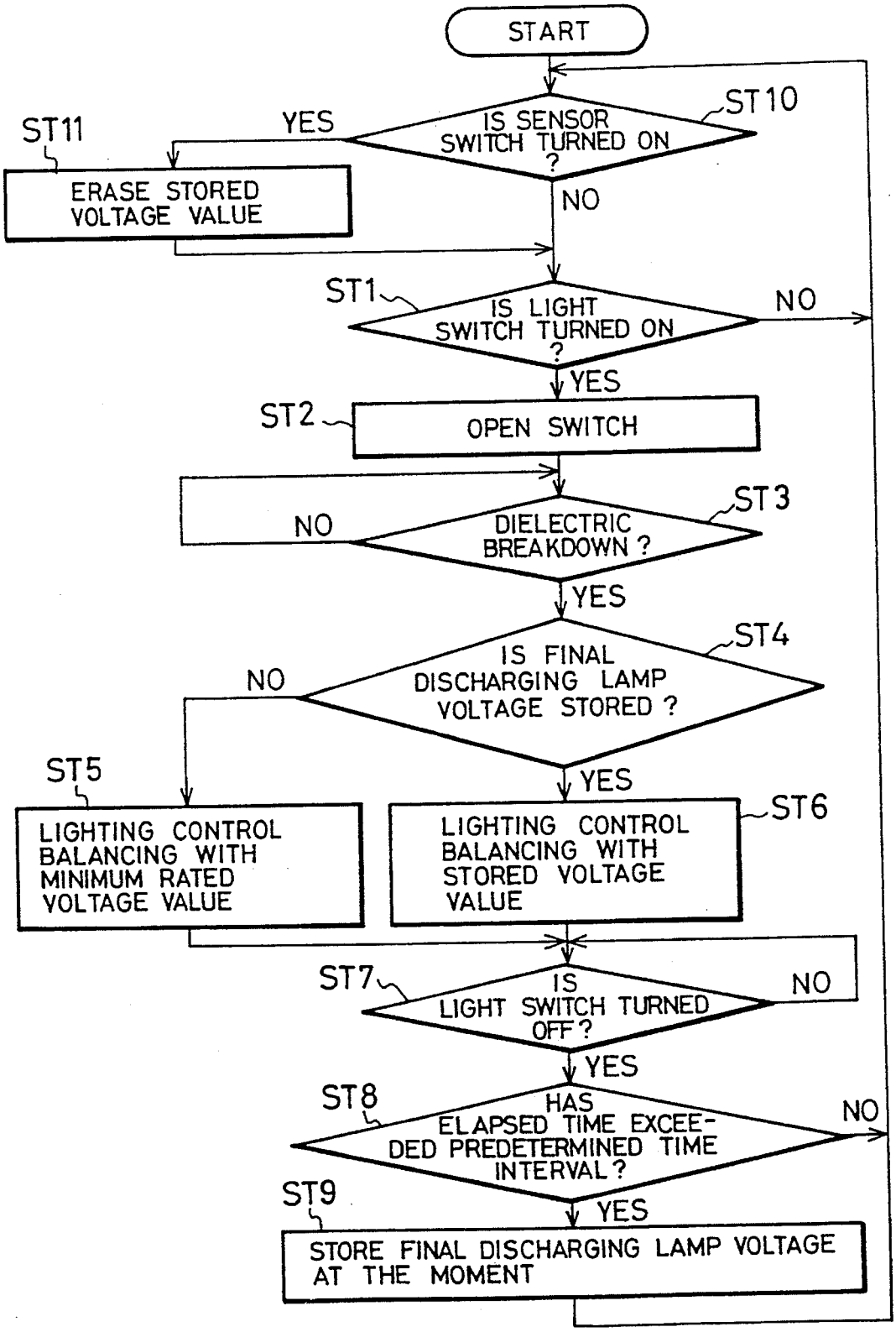
FIG. 9 is a flow chart showing an operation of a control section in the embodiment 2.

The operation will now be described. FIG. 9 is a flow chart showing the operation of the control section 13 in the embodiment 2. In FIG. 9, Steps marked by ST1 to ST9 are identical with those marked by the same reference numerals in FIG. 3, and the descriptions of the Steps are omitted. In case the discharging lamp 5 can not be turned ON due to its expired lifetime or failure, the discharging lamp 5 is exchanged with a normal discharging lamp. At the time, when the discharging lamp 5 is removed with socket including the discharging lamp 5 from the fixed base 16, the sensor switch 17 is turned ON so as to input a high level signal into the control section 13. The control section 13 detects that the sensor switch 17 is turned ON by monitoring the signal (Step ST10), and erases the final discharging lamp voltage stored in the stable voltage storage means in the control section 13 (Step ST11).

In a later operation, the processing in Steps ST1 to ST9 are performed as in the case of the embodiment 1. In this case, since the final discharging lamp voltage of the stable voltage storage is erased by the processing in Step ST11, the operation proceeds to Step ST5 according to decision in Step ST4 so as to perform the lighting control of the discharging lamp 5 balancing with the minimum rated voltage value. Thereafter, the final discharging lamp voltage is stored in the stable voltage storage in Step ST9, and the lighting control of the discharging lamp 5 balancing with the final discharging lamp voltage is performed in the following operation.

The present invention has been described with respect to the respective embodiments in case employing the LC series resonance circuit 4 as a generator of high voltage for dielectric breakdown purpose. However, it must be noted that another type of high voltage generator means may be employed.

As set forth above, according to the first aspect of the present invention, there is provided a discharging lamp lighting apparatus to perform the power control according to the power control pattern balancing with the stored stable voltage of the discharging lamp. As a result, there is an effect in that the discharging lamp lighting apparatus can be provided to be continuously adapted to a varied characteristic of the discharging lamp even if characteristics of the discharging lamp may be varied, so as to rapidly provide the stable state of the amount of light.

Further, according to the second aspect of the present invention, there is provided a discharging lamp lighting apparatus in which the power control is performed according to the power control pattern balancing with the minimum rated voltage in case the stable voltage is not stored. As a result, there is an effect in that the discharging lamp lighting apparatus can be provided to prevent the amount of light of the discharging lamp from being excessive when applying the rated power in case the stable voltage is not stored, and to avoid a reduced life of the discharging lamp.

Besides, according to the third aspect of the present invention, there is provided a discharging lamp lighting apparatus in which it is decided that the discharging lamp lighting apparatus is in the stable state if the elapsed time from start of lighting in the discharging lamp exceeds the predetermined time interval. As a result, there is an effect in that the discharging lamp lighting apparatus can be provided to be prevented from storing voltage in the unstable state, and to avoid control according to an erroneous power control pattern.

In addition, according to the fourth aspect of the present invention, there is provided a discharging lamp lighting apparatus in which contents stored in the stable voltage storage are erased when the discharging lamp detector detects that the discharging lamp is once removed, and lighting control of the discharging lamp is performed from an initial state. As a result, there is an effect in that the discharging lamp lighting apparatus can be provided to avoid abnormal lighting control or lighting control exceeding the rating of a new discharging lamp immediately after exchanging a discharging lamp even if an abnormal value or higher voltage is stored in the stable voltage storage as final discharging lamp voltage due to failure or expired lifetime of the discharging lamp.

While preferred embodiments of the invention have been described using specific terms, such description is for illustrative purposes only, and it is to be understood that changes and variations may be made without departing from the spirit or scope of the following claims.

What is claimed is:

1. A discharging lamp lighting apparatus for updating a desired voltage value to be applied to a discharging lamp when the discharging lamp is lighted at a rated power, each time the discharge light is lighted, comprising:

power supplying means for supplying power for said discharging lamp;

dielectric breakdown detecting means for detecting dielectric breakdown of said discharging lamp;

voltage detecting means for detecting voltage applied to said discharging lamp;

stable voltage storing means for storing the desired voltage value when said discharging lamp is stabilized; and control means for providing said power supplying means with an instruction defining said desired voltage value previously stored in said stable voltage storing means as a target value when said dielectric breakdown detecting means detects occurrence of said dielectric breakdown of said discharging lamp, damping current flowing through said discharging lamp such that said voltage of said discharging lamp becomes said target value previously stored in said stable voltage storing means when power consumption of said discharging lamp becomes the rated power, and detecting voltage applied to said discharging lamp by said voltage detecting means, when said discharging lamp is stabilized, to update said desired voltage value stored in said stable voltage storing means.

2. A discharging lamp lighting apparatus for updating a desired voltage value to be applied to a discharging lamp when the discharging lamp is lighted at a rated power, each time the discharge light is lighted, comprising:

power supplying means for supplying power for a discharging lamp;

dielectric breakdown detecting means for detecting dielectric breakdown of said discharging lamp;

voltage detecting means for detecting voltage applied to said discharging lamp;

stable voltage storing means for storing the desired voltage value when said discharging lamp is stabilized; and control means for providing said power supplying means with an instruction of defining said desired voltage value previously stored in said stable voltage storing means as a target value when said voltage value is stored in said stable voltage storing means, and defining a predetermined minimum rated voltage of said discharging lamp as said target voltage value when no voltage is stored in said stable voltage storing means, when said dielectric breakdown detecting means detects occurrence of said dielectric breakdown of said discharging lamp, damping current flowing through said discharging lamp such that said voltage of said discharging lamp becomes said target value when power consumption of said discharging lamp becomes said rated power, and detecting voltage applied to said discharging lamp by said voltage detecting means, when said discharging lamp is stabilized, to update said desired voltage value stored in said stable voltage storing means.

3. A discharging lamp lighting apparatus according to claim 1, wherein said stable voltage storing means comprises a timer for measuring time, and deciding means for deciding that said discharging lamp is stabilized if time interval from start of lighting measured by said timer exceeds a predetermined time interval.

4. A discharging lamp lighting apparatus according to claim 2, wherein said stable voltage storing means comprises a timer for measuring time, and deciding means for deciding that said discharging lamp is stabilized if time interval from start of lighting measured by said timer exceeds a predetermined time interval.

5. A discharging lamp lighting apparatus according to claim 1 further comprising:

discharging lamp detecting means for detecting whether said discharging lamp is mounted, said control means having a function of erasing said voltage value stored in said stable voltage storing means when said discharging lamp detecting means detects that said discharging lamp is once removed, and performing lighting control of said discharging lamp from an initial state.

6. A discharging lamp lighting apparatus according to claim 2 further comprising:

discharging lamp detecting means for detecting whether said discharging lamp is mounted, said control means having a function of erasing said voltage value stored in said stable voltage storing means when said discharging lamp detecting means detects that said discharging lamp is once removed, and performing lighting control of said discharging lamp by utilizing said predetermined minimum rated voltage as said target value.

7. A discharging lamp lighting apparatus according to claim 3 further comprising:

discharging lamp detecting means for detecting whether said discharging lamp is mounted, said control means having a function of erasing said voltage value stored in said stable voltage storing means when said discharging lamp detecting means detects that said discharging lamp is once removed, and performing lighting control of said discharging lamp from an initial state.

8. A discharging lamp lighting apparatus according to claim 4 further comprising:

discharging lamp detecting means for detecting whether said discharging lamp is mounted, said control means having a function of erasing said voltage value stored in said stable voltage storing means when said discharging lamp detecting means detects that said discharging lamp is once removed, and performing lighting control of said discharging lamp by utilizing said predetermined minimum rated voltage as said target value.

9. A lamp comprising:

a light source;

a current supply, supplying current to said light source;

a voltage detector, detecting voltage supplied across said light source;

a memory, storing a desired voltage value representing the voltage detected by said voltage detector before turning off a stable operation of said light source;

a current controller, operatively connected to said current supply and voltage detector, controlling said current supply to damp current supplied to said light source after detection of a dielectric breakdown of said light source such that said light source begins operating at rated power at substantially the same time a desired voltage value previously stored in said memory becomes applied across said light source, controlling said current supply to maintain operation of said light source at rated power, and detecting voltage applied to said light source by said voltage detecting means when said light source is stabilized to update said desired voltage value stored in said memory.

10. The lamp of claim 9, wherein said controller controls said light source to reach said desired voltage value previously stored by said memory when said memory has stored said desired voltage value and controls said light source to reach a predetermined minimum rated voltage value when said memory has not stored said desired voltage value.

11. The lamp of claim 10, wherein said controller controls said current supply to damp current so that the current supplied to said light source has a linear relationship to the voltage applied across said light source.

12. The lamp of claim 11, further including a light source detector detecting the presence of said light source; and wherein said memory is reset when said light source detector determines said light source is replaced.

13. The lamp of claim 12, wherein said memory stores a voltage value if the lamp has been operating for a predetermined time period.

14. A discharging lamp comprising:

a light bulb;

a power supply, supplying power to said light bulb;

a voltage detector, detecting voltage supplied across said light bulb;

a memory for storing a target voltage value representing the voltage detected by said voltage detector across said light bulb when the lamp is operating in a stable condition; and a power controller, operatively connected to said power supply and said voltage detector, controlling said power supply to supply high power to said light bulb to start a dielectric breakdown;

diminish power supplied to said light bulb after detecting a dielectric breakdown so that a target voltage previously stored in said memory is reached across said light bulb;

maintain a low power across said light bulb after said target voltage is reached; and detect voltage applied across said light bulb by said voltage detector to update said target voltage value stored in said memory.

15. The lamp of claim 14, wherein said power controller controls said power supply to diminish power so that a predetermined minimum rated voltage is reached across said light bulb, if no target voltage is stored in said memory.

16. The lamp of claim 15, wherein said power controller controls said power supply to diminish power so that said target voltage previously stored in said memory is reached substantially the same time said low power is supplied to said light bulb.

17. The lamp of claim 16, wherein said power controller controls said power supply to diminish power so that a linear relationship is maintained between the voltage and current applied to said light bulb.

18. A method of operating a discharge lamp, comprising:

(a) supplying a high power to the discharge lamp to induce a dielectric breakdown;

(b) detecting a dielectric breakdown;

(c) damping a current supplied to the discharge lamp after detection of a dielectric breakdown in step (b) to supply a previously stored desired voltage across the discharge lamp at substantially the same time the discharge lamp operates at a rated power; and (d) updating said previously stored desired voltage by detecting applied voltage across said discharging lamp when said lamp is operating in a stable condition.

19. The method of claim 18, wherein step (c) further includes damping the current to supply a predetermined minimum rated voltage at least the first time the discharge lamp is operated.

20. The method of claim 19, further including (e) maintaining the power supplied to the discharge lamp at a minimum rated power, wherein said step (c) includes damping the current to supply said voltage value across the discharge lamp if a voltage value has been stored previously in said step (d).

21. The method of claim 18, wherein said step (c) includes damping the current in a manner to retain a Linear relationship between the current and voltage supplied to the discharge lamp.

22. A method for updating a target value to be applied to a light source of a discharging lamp after detection of a dielectric breakdown of the light source, comprising:

(a) supplying a high power to the light source;

(b) detecting a dielectric breakdown of the light source;

(c) diminishing current supplied to the light source so that a previously stored target voltage value is reached across the light source;

(d) maintaining a low power level across the light source; and (e) updating said previously stored target voltage value by detecting a voltage across the light source when the discharge lamp is lighted under a stable condition.

23. The method of claim 22, wherein said step (c) includes diminishing current supplied to the light source so that the target voltage value stored in a previous updating step is reached substantially the same time the low power level is first supplied to the light source.

24. The method of claim 23, wherein said step (c) includes diminishing current supplied to the light source so that a linear relationship between current and voltage supplied to the light source is maintained.

* * * * *